US009291975B2

(12) United States Patent
Taguchi

(10) Patent No.: US 9,291,975 B2
(45) Date of Patent: Mar. 22, 2016

(54) SHEET-EDGE DETECTING DEVICE AND IMAGE FORMING APPARATUS

(71) Applicant: FUJI XEROX CO., LTD., Tokyo (JP)

(72) Inventor: Yoshiyuki Taguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/615,495

(22) Filed: Feb. 6, 2015

(65) Prior Publication Data

US 2015/0234337 A1 Aug. 20, 2015

(30) Foreign Application Priority Data

Feb. 14, 2014 (JP) ..... 2014-026731

(51) Int. Cl.
*B65H 23/00* (2006.01)
*G03G 15/00* (2006.01)
*B41J 11/00* (2006.01)

(52) U.S. Cl.
CPC .. *G03G 15/6526* (2013.01); *G03G 2215/00459* (2013.01); *G03G 2215/00556* (2013.01); *G03G 2215/00616* (2013.01)

(58) Field of Classification Search
CPC ... G03G 15/00; G03G 15/6529; B65H 23/00; B65H 23/02; B65H 23/032; B65H 23/035; B65H 7/00; B65H 7/02; B65H 7/10; B41J 11/00; B41J 11/41; B41J 13/00; B41J 11/42
See application file for complete search history.

(56) References Cited

U.S. PATENT DOCUMENTS

| | | | | |
|---|---|---|---|---|
| 2009/0238619 | A1* | 9/2009 | Aoki | 399/371 |
| 2011/0211891 | A1* | 9/2011 | Nakamura | 399/407 |
| 2012/0003024 | A1* | 1/2012 | Kaiga et al. | 399/394 |
| 2015/0037080 | A1* | 2/2015 | Fukatsu et al. | 399/407 |

FOREIGN PATENT DOCUMENTS

| | | | | |
|---|---|---|---|---|
| JP | 7-291497 A | | 11/1995 | |
| JP | 9-188441 A | | 7/1997 | |
| JP | 2006227375 A | * | 8/2006 | B41J 11/42 |
| JP | 2006248097 A | * | 9/2006 | B41J 29/38 |
| JP | 2008120535 A | * | 5/2008 | G03G 15/00 |
| JP | 2008290356 A | * | 12/2008 | B41J 29/38 |
| JP | 2009285918 A | * | 12/2009 | |

* cited by examiner

*Primary Examiner* — Nguyen Ha
(74) *Attorney, Agent, or Firm* — Sughrue Mion, PLLC

(57) ABSTRACT

A sheet-edge detecting device includes first and second detecting units and a determining unit. The detecting units are disposed at an edge of a sheet having feed holes in a direction crossing a transporting direction of the sheet, and are separated from each other in the transporting direction so as not to be positioned in one or more feed holes simultaneously. In the direction crossing the transporting direction, the detecting units are separated from each so as not to be positioned in a feed hole and outside the edge simultaneously, one of the detecting units is at a position corresponding to an allowable displacement of the edge, and the other detecting unit is at the same position as the one of the detecting units or closer to the edge than the one of the detecting units is. The determining unit determines the position of the edge of the sheet.

8 Claims, 7 Drawing Sheets

SHEET-EDGE DETECTING DEVICE AND IMAGE FORMING APPARATUS

CROSS-REFERENCE TO RELATED APPLICATIONS

This application is based on and claims priority under 35 USC 119 from Japanese Patent Application No. 2014-026731 filed Feb. 14, 2014.

BACKGROUND

Technical Field

The present invention relates to a sheet-edge detecting device and an image forming apparatus.

SUMMARY

According to an aspect of the invention, there is provided a sheet-edge detecting device including first and second detecting units and a determining unit. The first and second detecting units are disposed at an edge of a sheet having feed holes in a direction crossing a transporting direction of the sheet, the edge serving as a transport reference. The first and second detecting units are separated from each other in the transporting direction of the sheet by a distance such that the first and second detecting units are not positioned in one or more of the feed holes at the same time. In the direction crossing the transporting direction of the sheet, the first and second detecting units are separated from each other by a distance such that the first and second detecting units are not positioned in one of the feed holes and outside the edge of the sheet at the same time, one of the first and second detecting units is located at a position corresponding to an allowable displacement of the edge of the sheet to be detected, and the other one of the first and second detecting units is located at the same position as the one of the first and second detecting units or closer to the edge of the sheet than the one of the first and second detecting units is. The first and second detecting units detect presence or absence of the sheet. The determining unit determines the position of the edge of the sheet on the basis of detection results obtained by the first and second detecting units.

BRIEF DESCRIPTION OF THE DRAWINGS

An exemplary embodiment of the present invention will be described in detail based on the following figures, wherein.

DETAILED DESCRIPTION

An exemplary embodiment for carrying out the present invention (hereinafter referred to simply as an exemplary embodiment) will be described with reference to the accompanying drawings.

Figure 1:
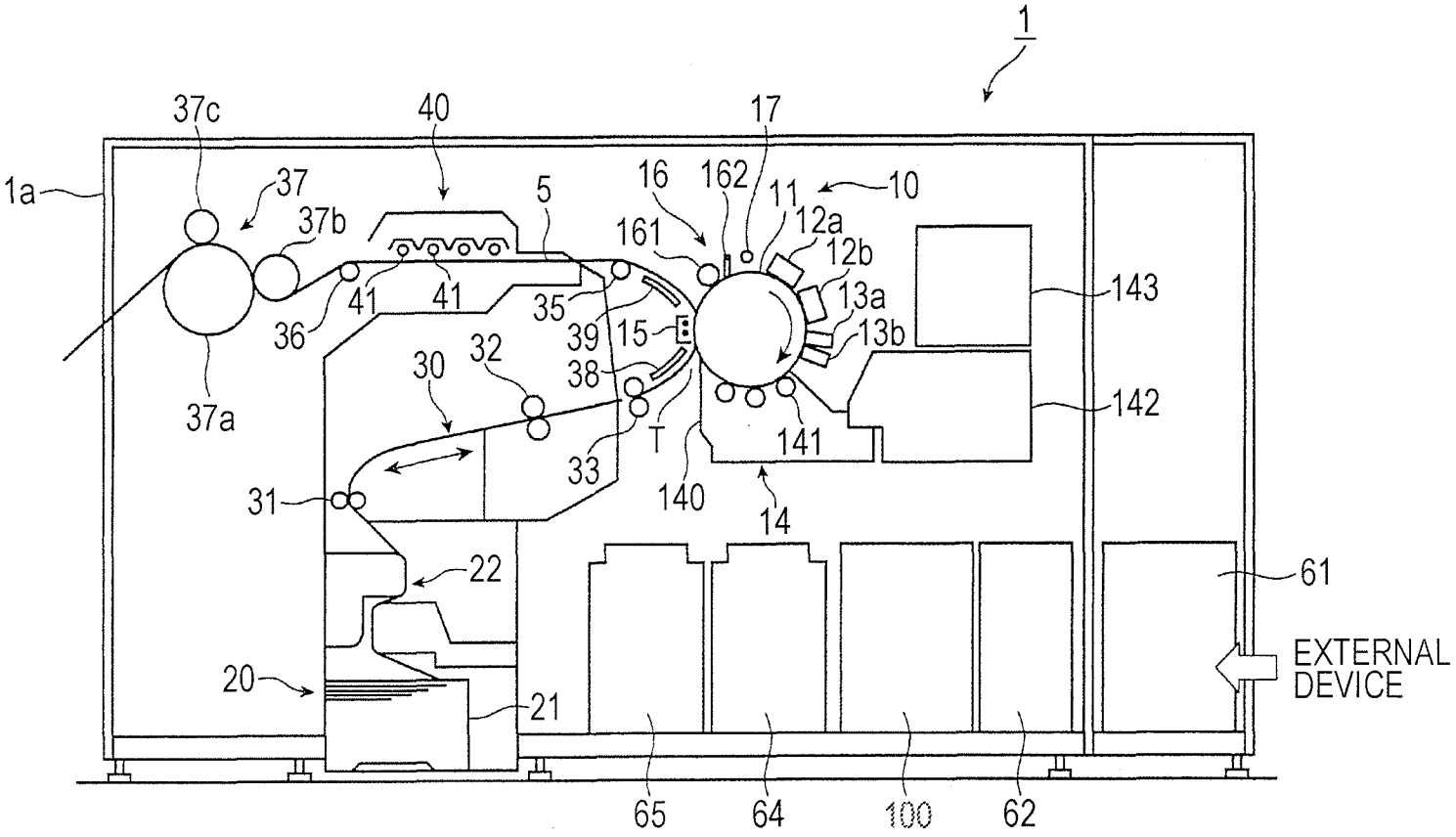
FIG. 1 illustrates the schematic structure of an image forming apparatus including a sheet-edge detecting device according to a first exemplary embodiment of the present invention.

FIG. 1 illustrates the overall structure of an image forming apparatus 1 including a sheet-edge detecting device according to a first exemplary embodiment.

Overall Structure of Image Forming Apparatus

The image forming apparatus 1 according to the first exemplary embodiment is constructed as, for example, a continuous-feed printer that records images on continuous paper having feed holes for pin feeding. The image forming apparatus 1 includes an image forming device 10 that forms a toner image developed with toner included in developer; a paper feed device 20 that contains continuous paper 5, which serves as a predetermined recording medium to be fed to a transfer position of the image forming device 10, and feeds the continuous paper 5; a transporting device 30 that serves as an example of a transporting unit that transports the continuous paper 5 fed by the paper feed device 20; and a fixing device 40 that fixes the toner image that has been transferred onto the continuous paper 5 by the image forming device 10.

The image forming apparatus 1 includes a housing 1*a*, which includes a support structural member and an outer cover. The solid line denoted by 5 in FIG. 1 shows a transport path along which the continuous paper 5 is transported in the housing 1*a*.

The image forming device 10 is disposed at a predetermined location in the housing 1*a*. As illustrated in FIG. 1, the image forming device 10 includes a photoconductor drum 11 as an example of an image carrier that rotates. First and second charging devices 12*a* and 12*b*, first and second exposure devices 13*a* and 13*b*, a developing device 14, a transferring device 15, a drum cleaning device 16, and an electricity removing device 17 are arranged around the photoconductor drum 11. The first and second charging devices 12*a* and 12*b* charge, to a predetermined potential, a peripheral surface (image carrying surface) of the photoconductor drum 11 on which an image may be formed. The first and second exposure devices 13*a* and 13*b* serve as electrostatic-latent-image forming units that form an electrostatic latent image having a potential difference by irradiating the charged peripheral surface of the photoconductor drum 11 with light based on information (signal) of an image. The developing device 14 serves as a developing unit that develops the electrostatic latent image with toner included in developer of a desired color (for example, black) to form a toner image. The transferring device 15 transfers the toner image onto the continuous paper 5. The drum cleaning device 16 cleans the image carrying surface of the photoconductor drum 11 by removing adhering substance, such as toner that remains on the image carrying surface after the transfer process. The electricity removing device 17 removes electricity from the image carrying surface of the photoconductor drum 11 that has been cleaned.

The photoconductor drum 11 is obtained by forming an image carrying surface having a photoconductive layer (photosensitive layer) made of a photosensitive material on a peripheral surface of a cylindrical or columnar grounded base member. The photoconductor drum 11 is supported so as to be rotatable in a direction shown by the arrow when power is transmitted from a rotational driving device (not shown).

The first and second charging devices 12*a* and 12*b* are non-contact charging devices, such as corona dischargers, which are arranged so as not to be in contact with the photoconductor drum 11.

The first and second exposure devices 13*a* and 13*b* form an electrostatic latent image by irradiating the charged peripheral surface of the photoconductor drum 11 with light that corresponds to information of an image input to the image forming apparatus 1 from an external device. The first and second exposure devices 13*a* and 13*b* may be, for example, LED print heads. In a latent-image forming process, the information (signal) of the image input to the image forming apparatus 1 by a certain unit is transmitted to the first and second exposure devices 13*a* and 13*b*.

The developing device 14 includes a housing 140 that has an opening positioned so as to face the photoconductor drum 11 and a chamber that contains the developer. The housing 140 accommodates plural developing rollers 141 that carry the developer and transport the developer to a developing region that faces the photoconductor drum 11; a stirring-and-transporting member, such as a screw auger (not shown), which causes the developer to pass the developing rollers 141 while stirring the developer; and a layer-thickness regulating member that regulates the amount of developer carried by the developing rollers 141 (layer thickness). A developing voltage supplied by a power supply (not shown) is applied between the photoconductor drum 11 and the developing rollers 141 of the developing device 14. The developing rollers 141 and the stirring-and-transporting member (not shown) receive power from a rotational driving device (not shown) and rotate in a predetermined direction. A two-component developer including non-magnetic toner and magnetic carrier is used as the above-described developer. Referring to FIG. 1, a developer supplying device 142 supplies the developer, which includes at least the toner, to the developing device 14, and a developer container 143 contains the developer.

The transferring device 15 is a non-contact transferring device that is arranged so as to face the peripheral surface of the photoconductor drum 11 at the transfer position T and includes a corotron that receives a transferring voltage. The transferring voltage is a direct-current voltage having a polarity opposite to the charging polarity of the toner, and is supplied from the power supply (not shown).

The drum cleaning device 16 includes a cleaning brush 161, a cleaning plate 162, and a discharging member, such as a screw auger (not shown). The cleaning brush 161 is disposed in a container-shaped body (not shown) and performs cleaning by removing adhering substance, such as residual toner. The cleaning plate 162 also performs cleaning by removing the adhering substance, such as residual toner. The discharging member transports the substance, such as toner, removed by the cleaning brush 161 and the cleaning plate 162 so as to discharge the substance to a collecting system (not shown). The cleaning plate 162 may be, for example, a plate-shape member (for example, a blade) made of rubber or the like.

The fixing device 40, which is an example of a fixing unit, is a flash fixing device that is fixed in the apparatus housing 1*a*. The fixing device 40 includes plural flash lamps (four flash lamps in FIG. 1) 41 that extend in a direction crossing the transporting direction of the continuous paper 5 (direction perpendicular to FIG. 1). When the flash lamps 41 are turned on, the toner image is fixed to the continuous paper 5 by heat of radiation from the flash lamps 41. The fixing device is not limited to the flash fixing device, and may instead include a roll-shaped or belt-shaped fixing member as an example of a heating unit and a roll-shaped or belt-shaped pressing member as an example of a pressing unit. In such a fixing device, contact portions of the fixing member and the pressing member serve as a fixing process portion that performs a predetermined fixing process (heating and pressing).

The paper feed device 20 is disposed below the fixing device 40. The paper feed device 20 includes at least one paper container (paper hopper) 21 that contains the continuous paper 5 that is folded in a desired size (for example, A4 or A3 size); and a feeder 22 that feeds the continuous paper 5 from the paper container 21 in an unfolded state. The paper container 21 is attached to the apparatus housing 1*a* so as to be capable of being pulled out at, for example, the front side of the apparatus housing 1*a* (side that faces the user when the user operates the image forming apparatus 1).

Figure 2A:
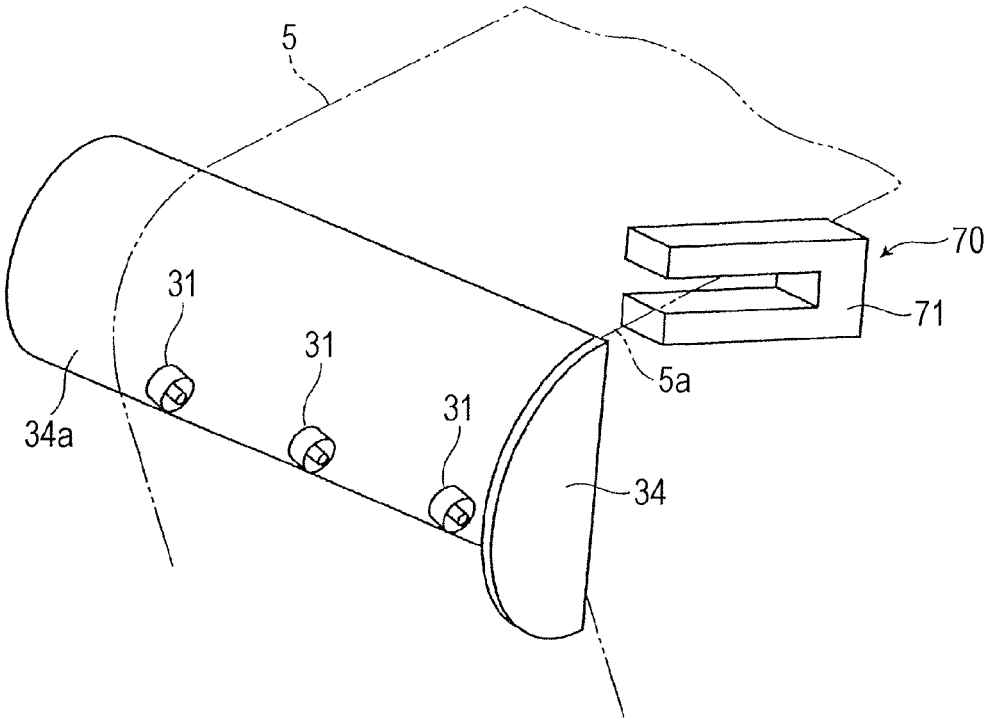
FIGS. 2A and 2B illustrate an edge guide provided on a transporting device that transports continuous paper.
Figure 2B:
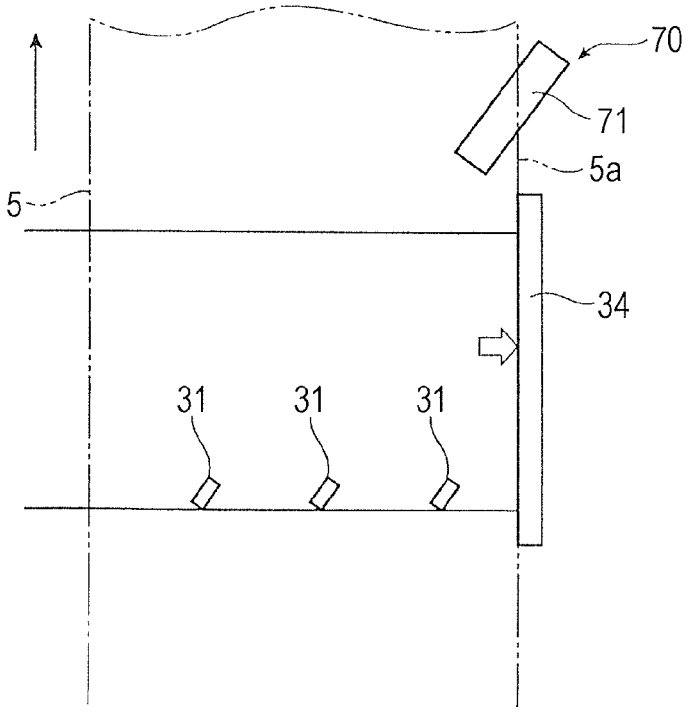

A transporting device 30, which includes plural paper transporting rollers 31, 32, and 33 and a transport guide, is disposed between the paper feed device 20 and the fixing device 40. The transporting device 30 transports the continuous paper 5 fed from the paper feed device 20 to the transfer position T by using an edge of the continuous paper 5 in a direction crossing the transporting direction of the continuous paper 5 as a reference. The paper transporting rollers 31 are positioned above the paper feed device 20 in the transporting device 30. As illustrated in FIGS. 2A and 2B, the paper transporting rollers 31 obliquely transport the continuous paper 5 while pressing an edge, which serves as a transport reference edge, of the continuous paper 5 in a direction crossing the transporting direction against a transport guide member (edge guide) 34, which is an example of a regulating unit. Thus, the paper transporting rollers 31 function as rollers (aligner rollers) that align the edge of the continuous paper 5 at a reference position, which is the position of the inner surface of the edge guide 34. A surface 34*a* of the transport guide member 34 that comes into contact with a transport surface of the continuous paper 5 has a curved shape.

The paper transporting rollers 33 are disposed immediately in front of the transfer position T in the transporting device 30. The paper transporting rollers 33 function as rollers (registration rollers) that adjust the time at which the continuous paper 5 is transported when an image forming operation is started.

Paper rollers 35 and 36 that transport the continuous paper 5 to which the toner image has been transferred are disposed downstream of the transfer position T in the paper transporting direction. The transporting device 30 further includes an ejection roller pair 37 disposed downstream of the fixing device 40. The ejection roller pair 37 transports the continuous paper 5 while applying a tension thereto, and ejects the continuous paper 5 to the outside of the housing 1*a*. The ejection roller pair 37 includes a driving roller 37*a* that is rotated by a driving unit (not shown) and two driven rollers 37*b* and 37*c* that come into contact with the continuous paper 5 while the continuous paper 5 is wrapped around the peripheral surface of the driving roller 37*a*.

In the transporting device 30, the paper transporting rollers 31 to 33 and the ejection roller pair 37, which are arranged on both sides of the transfer position T, are configured such that, for example, the transporting time of the continuous paper 5 may be adjusted and the transporting direction of the continuous paper 5 may be switched between a forward direction, which is a direction from the paper feed device 20 toward the transfer position T, and a reverse direction, which is a direction from the transfer position T toward the paper feed device 20.

Referring to FIG. 1, transport guides 38 and 39, which guide the continuous paper 5 so that the continuous paper 5 comes into contact with the peripheral surface of the photoconductor drum 11, are disposed upstream and downstream of the transfer position T.

Figure 3:
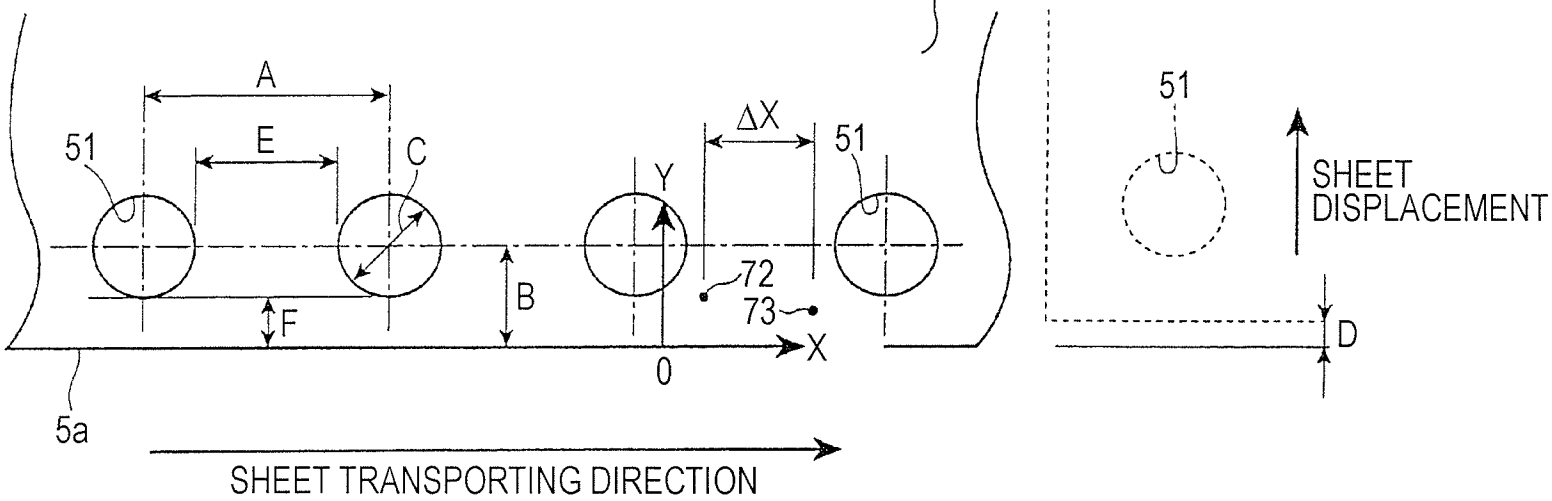
FIG. 3 illustrates continuous paper having feed holes for pin feeding.

The continuous paper 5 fed from the paper feed device 20 is, for example, so-called pinless continuous paper which has a certain width in a direction crossing the transporting direction (hereinafter referred to as a "width direction") and which does not have feed holes at both edges in the width direction. Alternatively, as illustrated in FIG. 3, the continuous paper 5 may be so-called pin-feed continuous paper as necessary. The pin-feed continuous paper has feed holes 51 that are formed at both edges in the direction crossing the transporting direction (hereinafter referred to as a "width direction") and arranged at a predetermined pitch A in the transporting direction.

In FIG. 3, A is the distance between the centers of the adjacent feed holes 51 (pitch), B is the distance from an edge 5*a* of the continuous paper 5 to the centers of the feed holes 51, C is the diameter of the feed holes 51, and D is an allowable amount of a displacement of the edge of the continuous paper 5 that is to be detected by a sheet-edge detecting device 70, which will be described below.

In the continuous paper 5, the distance A between the centers of the adjacent feed holes 51 (pitch) is set to a certain value (for example, 12.7 mm). The distance B from the edge 5*a* of the continuous paper 5 to the centers of the feed holes 51 is set to 5.2 mm irrespective of the diameter of the feed holes 51. The diameter C of the feed holes 51 is generally set to 4 mm; however, there also are feed holes 51 having a diameter C of 6 mm. The values of the continuous paper 5 are not limited to these values.

In FIG. 1, a page buffer 61 is an example of an image storage unit that stores image data transmitted from an external device, such as a computer. Reference numeral 62 denotes a bag filter. A controller 100 controls the overall operation of the image forming apparatus 1. Power supply circuits 64 and 65 supply a predetermined voltage and current to the image forming apparatus 1.

Basic Operation of Image Forming Apparatus

A basic image forming operation performed by the image forming apparatus 1 will now be described.

When the image forming apparatus 1 receives command information of a request for the image forming operation (print), the image forming device 10 and other devices are activated.

Referring to FIG. 1, in the image forming device 10, first, the photoconductor drum 11 starts to rotate in the direction shown by the arrow, and the first and second charging devices 12*a* and 12*b* charge the surface of the photoconductor drum 11 to a predetermined polarity (negative polarity in the present exemplary embodiment) and potential. Next, the first and second exposure devices 13*a* and 13*b* irradiate the charged surface of the photoconductor drum 11 with light that is emitted in accordance with a signal of an image input to the image forming apparatus 1, so that an electrostatic latent image having a predetermined potential difference is formed on the surface of the photoconductor drum 11.

Next, the developing device 14 develops the electrostatic latent image on the photoconductor drum 11 by causing the toner, which is charged to a predetermined polarity (negative polarity), to electrostatically adhere to the electrostatic latent image. As a result of this developing process, the electrostatic latent image formed on the photoconductor drum 11 is made visible as a toner image formed of the toner.

Next, when toner images of respective colors formed on the photoconductor drum 11 of the image forming device 10 reach the transfer position T, the transferring device 15 transfers the toner images onto the continuous paper 5.

After the transferring process, in the image forming device 10, the drum cleaning device 16 cleans the surface of the photoconductor drum 11 by scraping off the adhering substance therefrom. Lastly, the electricity removing device 17 removes electricity from the surface of the photoconductor drum 11 that has been cleaned. Thus, the image forming device 10 is set to the state in which the next image forming operation may be performed.

Next, the continuous paper 5 to which the toner images have been transferred is separated from the photoconductor drum 11 and transferred to the fixing device 40. The fixing device 40 causes the continuous paper 5 that has been subjected to the transferring process to pass therebelow, thereby fixing the unfixed toner images to the continuous paper 5 by heat of radiation from the flash lamps 41. After the fixing process, the continuous paper 5 is ejected by the ejection roller pair 37 to, for example, an ejected-paper receiver (not shown) disposed outside the housing 1*a*.

As a result of the above-described operation, the continuous paper 5 on which an image formed of the toner images is formed is output.

Structure of Sheet-Edge Detecting Device

Figure 4:
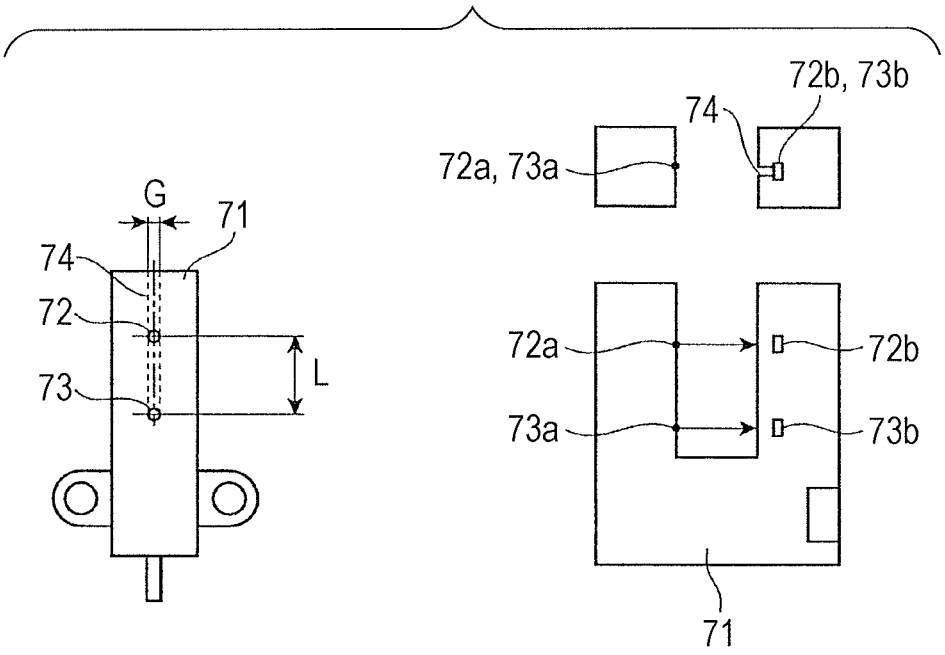
FIG. 4 illustrates a photosensor included in a sheet-edge detecting device according to a first exemplary embodiment of the present invention.

FIG. 4 illustrates the structure of the sheet-edge detecting device 70 included in the image forming apparatus according to the first exemplary embodiment.

As illustrated in FIGS. 2A and 2B, in the image forming apparatus 1, the aligner rollers 31 obliquely transport the continuous paper 5 while pressing the edge 5*a* (reference edge) of the continuous paper 5 in the width direction against the edge guide 34, so that the edge 5*a* of the continuous paper 5 is aligned at the reference position.

In the present exemplary embodiment, the sheet-edge detecting device 70, which detects the position of the edge 5*a* of the continuous paper 5 in the width direction, is disposed downstream of the edge guide 34 in the transporting direction and in the vicinity of the edge guide 34. The sheet-edge detecting device 70 detects the position of the edge 5*a* of the continuous paper 5 and determines whether or not a position displacement of the edge 5*a* of the continuous paper 5 in the width direction is smaller than or equal to an allowable displacement from the reference position determined by the edge guide 34.

As illustrated in FIGS. 2A, 2B, and 4, the sheet-edge detecting device 70 includes a two-beam transmission photosensor 71 including first and second detectors 72 and 73, which are examples of first and second detecting units. The first and second detectors 72 and 73 are disposed at positions corresponding to the reference-side edge 5*a* (edge adjacent to the edge guide 34) of the continuous paper 5 in the width direction, and are spaced from each other by a predetermined distance in the transporting direction of the continuous paper 5. The two-beam transmission photosensor 71 may be, for example, Model No. KI 663 manufactured by Shinko Denshi Co., Ltd. The first and second detectors 72 and 73 of the transmission photosensor 71 include first and second light emitting elements 72*a* and 73*a*, respectively, and first and second light receiving elements 72*b* and 73*b*, respectively. A slit 74 having a gap G of about 0.8 mm is formed at the light-receiving side of the first and second light receiving elements 72*b* and 73*b*. The slit 74 limits the light-receiving regions of the first and second light receiving elements 72*b* and 73*b* so that the position of the edge 5*a* of the continuous paper 5 may be detected in light-receiving regions that are substantially points having a size that corresponds to the opening width of the slit 74. The first and second detectors 72 and 73 output a signal "High", which indicates that paper is present, when the continuous paper 5 is being detected, and outputs a signal "Low", which indicates that paper is absent, when the continuous paper 5 is not detected.

In the present exemplary embodiment, the first and second detectors 72 and 73 of the photosensor 71 are separated from each other by a predetermined distance L (for example, 7 mm) in the longitudinal direction of the transmission photosensor 71.

In the present exemplary embodiment, when at least one of the first and second detectors 72 and 73 of the photosensor 71 detects that the paper is present, the displacement of the edge 5*a* of the continuous paper 5 is smaller than or equal to the allowable displacement D. When both the first and second detectors 72 and 73 detect that the paper is absent, the displacement of the edge 5*a* of the continuous paper 5 is greater than the allowable displacement D.

This will be described in more detail. In the present exemplary embodiment, as illustrated in FIG. 3, the photosensor 71 is arranged at an edge of the continuous paper 5 in the width direction in the following manner. That is, the distance ΔX between the first and second detectors 72 and 73 of the photosensor 71 in the transporting direction of the continuous paper 5 (X direction) is set so that the first and second detectors 72 and 73 are not positioned in the same feed hole 51 or adjacent feed holes 51 at the same time. More specifically, the distance ΔX is set so as to be greater than the diameter C of the feed holes 51 in the continuous paper 5 and smaller than the distance E (=A−C) between the opposing ends of the adjacent feed holes 51. In other words, the distance ΔX between the first and second detectors 72 and 73 in the transporting direction of the continuous paper 5 (X direction) satisfies the following Expression (1):

$$C<\Delta X<A-C \quad (1)$$

More specifically, assuming that the diameter of the feed holes 51 in the continuous paper 5 is 6 mm, which is a maximum diameter, the distance ΔX between the first and second detectors 72 and 73 in the transporting direction of the continuous paper 5 (X direction) is set so as to satisfy 6<ΔX<6.7 mm.

Figure 8A:
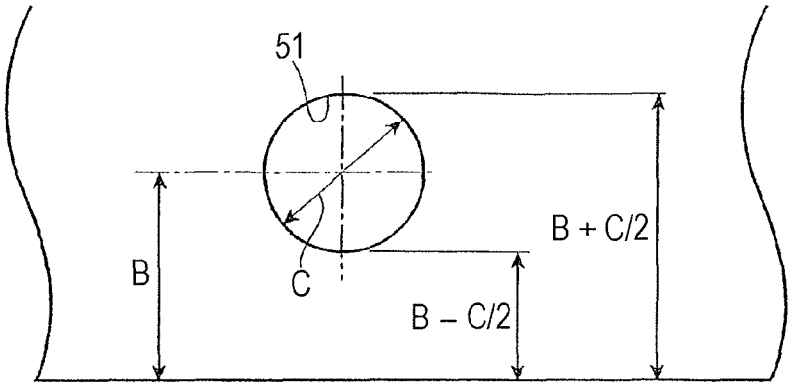
FIGS. 8A to 8D are schematic diagrams illustrating the manners in which an edge of the continuous paper is detected by the sheet-edge detecting device according to the first exemplary embodiment of the present invention.
Figure 8B:
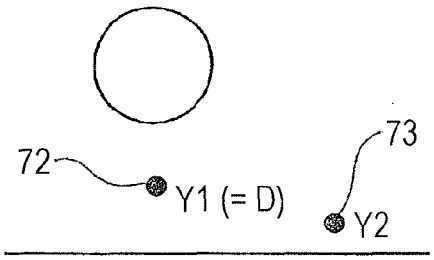

In addition, in the present exemplary embodiment, the coordinates Y1 and Y2 of the first and second detectors 72 and 73 in the width direction (Y direction), which is a direction crossing the transporting direction of the continuous paper 5, are set as follows. That is, assuming that the coordinate in the case where the edge 5*a* of the continuous paper 5 is at the reference position that corresponds to the edge guide 34 is "0", the first detector 72 is disposed at a position corresponding to the allowable displacement D (for example, 2 mm) of the edge of the continuous paper 5 to be detected. Moreover, referring to FIG. 8B, when Y1<B−C/2 is satisfied, that is, when the first detector 72 is closer to the edge of the continuous paper 5 than the feed holes 51 are, the second detector 73 is disposed as follows. That is, the second detector 73 is disposed at a position where the distance to the first detector 72 is smaller than the distance F between the edge 5*a* of the continuous paper 5 and the ends of the feed holes 51, and which is the same as the position of the first detector 72 or closer to the edge 5*a* of the continuous paper 5 than the first detector 72 is. In other words, the position Y2 of the second detector 73 in the width direction of the continuous paper 5 (Y direction) satisfies the following Expression (2):

$$Y2\leq Y1 \quad (2)$$

More specifically, assuming that the diameter of the feed holes 51 in the continuous paper 5 is 6 mm, which is a maximum diameter, the position Y2 of the second detector 73 in the width direction is set so as to satisfy Y2<2.2 mm. In this case, the first detector 72 is disposed at a position separated from the edge 5*a* of the continuous paper 5 by 2 mm, which is the allowable displacement. Accordingly, the position Y2 of the second detector 73 in the width direction is set so as to satisfy Y2≤2.0 mm based on Expression (2).

In the present exemplary embodiment, the coordinate Y1 of the first detector 72 in the width direction of the continuous paper 5 (Y direction) is at the position corresponding to the allowable displacement D of the edge of the continuous paper 5 to be detected, and the coordinate Y2 of the second detector 73 in the width direction of the continuous paper 5 (Y direction) is at the same position as the first detector 72 or closer to the edge 5*a* of the continuous paper 5 than the first detector 72 is. Therefore, the photosensor 71 is installed in an oblique state with respect to the transporting direction of the continuous paper 5 so that the first and second detectors 72 and 73 satisfy the above-described positional relationship.

Figure 8C:
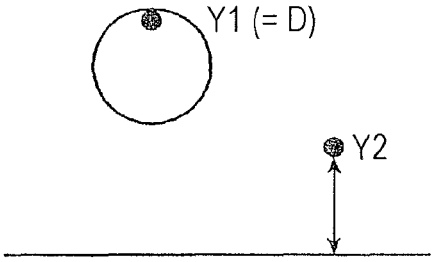

As illustrated in FIG. 8C, when B−C/2≤Y1≤B+C/2 is satisfied, that is, when the first detector 72 is at a position corresponding to the inner regions of the feed holes 51 in the continuous paper 5, the second detector 73 is disposed at a position separated from the edge 5*a* of the continuous paper 5 by a distance greater than the diameter C of the feed holes 51. This is because in the case where the first detector 72 is disposed at a position corresponding to the inner regions of the feed holes 51 in the continuous paper 5, if the second detector 73 is disposed at a position separated from the edge 5*a* of the continuous paper 5 by a distance smaller than the diameter C of the feed holes 51, the following problem will occur. That is, when the edge 5*a* of the continuous paper 5 is displaced inward beyond the second detector 73 and the second detector 73 detects that the paper is absent, there is a possibility that the first detector 72 will be positioned in one of the feed holes 51. In such a case, the first detector 72 also detects that the paper is absent. As a result, even though the displacement of the edge 5*a* of the continuous paper 5 has not yet reached the allowable displacement D, both the first and second detectors 72 and 73 detect that the paper is absent, and a detection failure occurs. For this reason, the second detector 73 is disposed inside the edge 5*a* of the continuous paper 5 when the first detector 72 is at a position corresponding to the inner regions of the feed holes 51 in the continuous paper 5. In other words, the positions Y1 and Y2 of the first and second detectors 72 and 73 in the width direction of the continuous paper 5 (Y direction) satisfy the following Expression (3):

$$C<Y2\leq Y1 \quad (3)$$

Figure 8D:
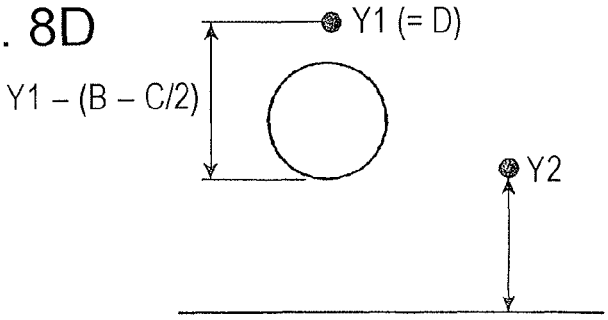

As illustrated in FIG. 8D, when B+C/2<Y1 is satisfied, that is, when the first detector 72 is on the inner side (side closer to the other edge of the continuous paper 5) of the feed holes 51 in the continuous paper 5, the second detector 73 is required to keep detecting that the paper is present until the first detector 72 finishes passing through the inner regions of the feed holes 51. In other words, the positions Y1 and Y2 of the first and second detectors 72 and 73 in the width direction of the continuous paper 5 (Y direction) satisfy the following Expression (4):

$$Y1-(B-C/2)<Y2\leq Y1 \quad (4)$$

The coordinate Y2 of the second detector 73 in the width direction of the continuous paper 5 (Y direction) may be the same as that of the first detector 72. However, considering, for example, the positioning errors of the first and second detectors 72 and 73, the coordinate Y2 is preferably set at a position closer to the edge 5*a* of the continuous paper 5 than the first detector 72 is.

Figure 5:
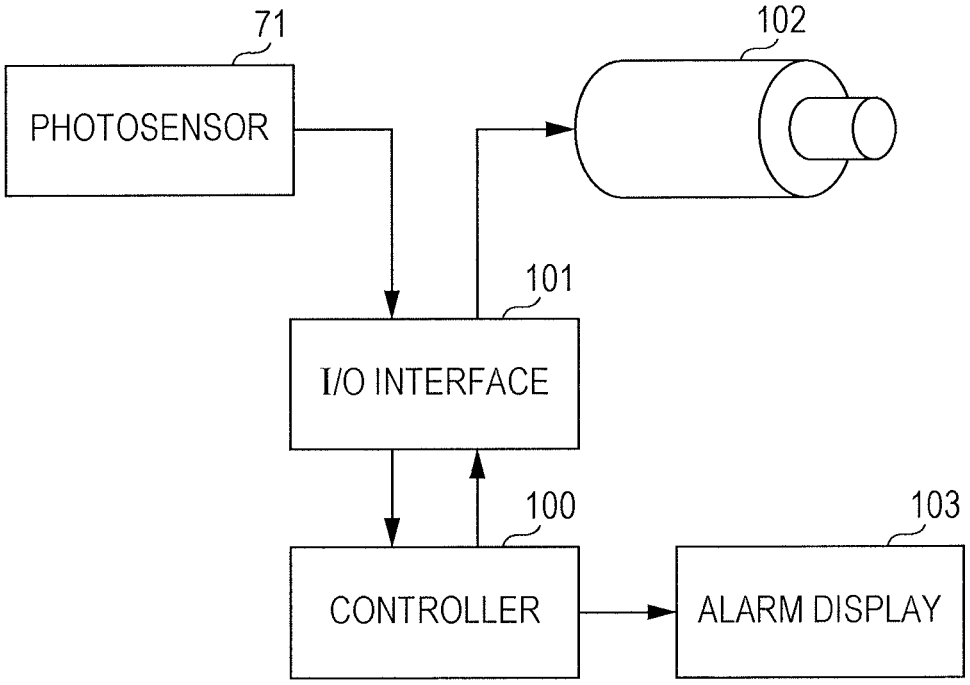
FIG. 5 is a block diagram of a controller included in the image forming apparatus.

FIG. 5 is a schematic block diagram of a control circuit of the sheet-edge detecting device according to the present exemplary embodiment.

Referring to FIG. 5, a signal output from the photosensor 71 is input to a controller 100 through an I/O interface 101. The controller 100 controls the overall operation of the image forming apparatus 1 on the basis of a program stored in a ROM (not shown) while referring to parameters and the like stored in a RAM (not shown). The controller 100 also functions as a determining unit that determines whether or not the displacement of the edge 5*a* of the continuous paper 5 is smaller than or equal to the allowable displacement D on the basis of the signal output from the photosensor 71.

A paper transport motor 102 is an example of a driving unit that drives the transporting device 30, which is an example of a transporting unit of the image forming apparatus 1.

An alarm display 103 displays a warning for the user of the image forming apparatus 1 when the displacement of the edge 5*a* of the continuous paper 5 exceeds the allowable displacement. The alarm display 103 includes, for example, a display panel, such as a liquid crystal panel, provided on an operation panel of the image forming apparatus 1. The alarm display 103 may be provided on a host apparatus, such as a computer, which issues a request for the image forming operation (print) to the image forming apparatus 1.

The alarm display 103 may display, for example, a message "check paper transport position" to warn the user that the displacement of the edge 5*a* of the continuous paper 5 is greater than the allowable displacement. The alarm display 103 may be configured to emit an alarm sound while displaying a certain message as long as the alarm display 103 is capable of warning the user.

Operation of Sheet-Edge Detecting Device

A sheet-edge detection operation performed by the sheet-edge detecting device will now be described.

When the power of the image forming apparatus 1 is turned on, the sheet-edge detecting device 70 detects the position of the edge 5*a* of the continuous paper 5, which extends through the transporting device 30 in the image forming apparatus 1, with the photosensor 71 before, during, or after the image forming operation or in a standby period. The photosensor 71 outputs a detection signal to the controller 100 through the I/O interface 101.

In the image forming apparatus 1, the continuous paper 5 is normally transported by the transporting device 30 while the edge 5*a* of the continuous paper 5 is in contact with the inner side surface of the edge guide 34. Therefore, the position of the edge 5*a* of the continuous paper 5 coincides with the position of the inner side surface of the edge guide 34.

However, the edge of the continuous paper 5 may become displaced from the edge guide 34 when, for example, the rotating shafts of the paper transporting rollers 31 to 33 included in the transporting device 30 have attachment errors, such as inclination errors, or when the image forming device 10 forms an image based on a print pattern having an unevenly high density in a region near one end of the photoconductor drum 11 in the axial direction thereof. The displacement may also occur depending on other factors, such as the type of the recording medium.

Figure 6A:
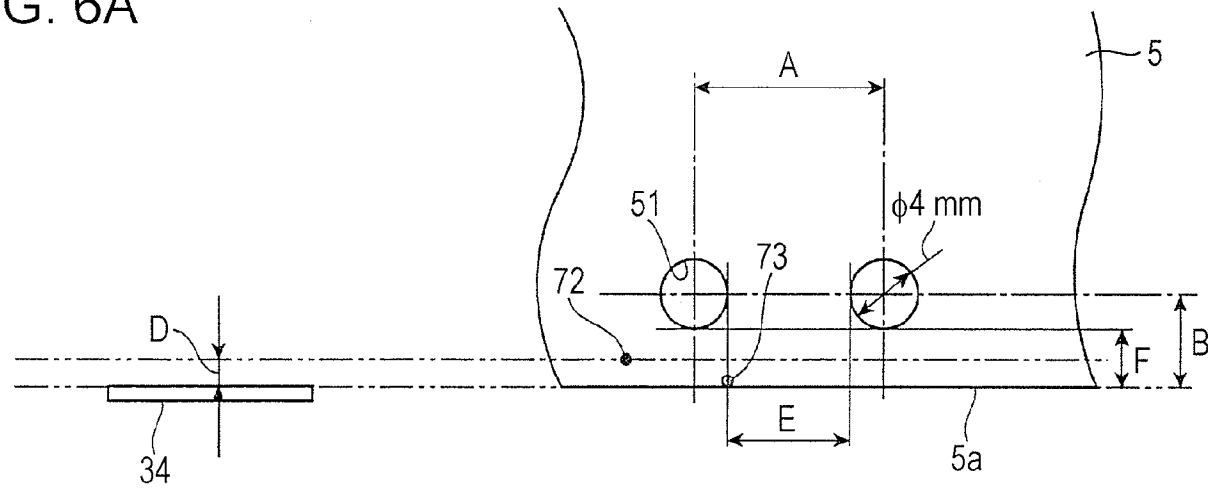
FIGS. 6A and 6B are schematic diagrams illustrating the manners in which an edge of the continuous paper is detected by the sheet-edge detecting device according to the first exemplary embodiment of the present invention.

When the reference edge 5*a* of the continuous paper 5 having the feed holes 51 with a diameter of 4 mm is at a position corresponding to the position of the edge guide 34, as illustrated in FIG. 6A, the first and second detectors 72 and 73 of the photosensor 71 are both positioned between the edge of the continuous paper 5 and the feed holes 51. Therefore, the first and second detectors 72 and 73 of the photosensor 71 each output a signal "High" (paper is present). The controller 100 determines that the displacement of the edge 5*a* of the continuous paper 5 is smaller than or equal to the allowable displacement D and is in a normal state on the basis of the detection signals output from the first and second detectors 72 and 73 of the photosensor 71 and indicating that the paper is present.

Figure 6B:
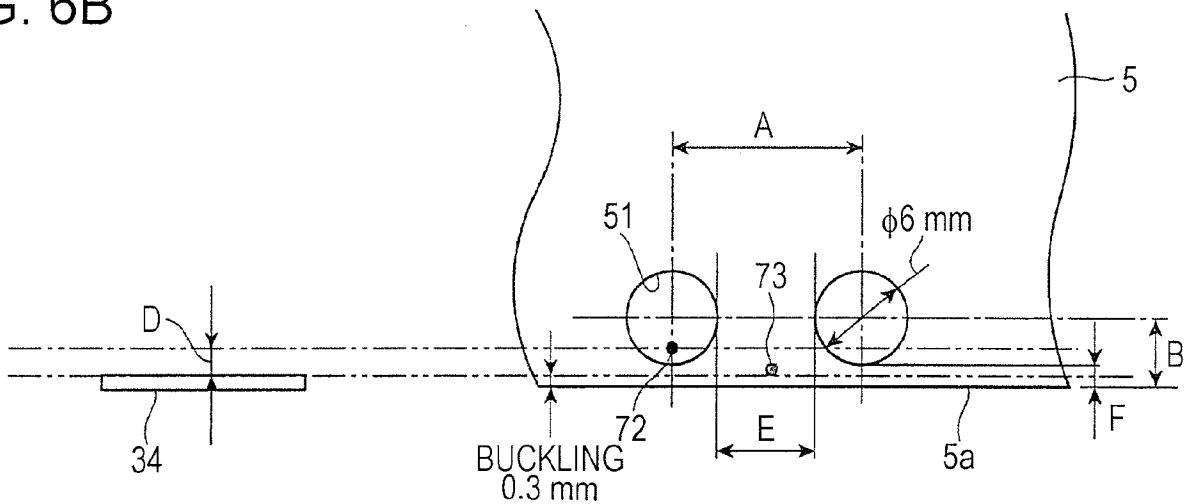

Next, assume that, as illustrated in FIG. 6B, the continuous paper 5 having the feed holes 51 with a diameter of 6 mm is excessively pressed against the edge guide 34 and buckling has occurred in which the edge 5*a* of the continuous paper 5 is displaced outward in the width direction beyond the edge guide 34 by, for example, 0.3 mm, and the first detector 72 of the photosensor 71 is disposed in one of the feed holes 51 in the continuous paper 5. In this case, among the first and second detectors 72 and 73 of the photosensor 71, the first detector 72 outputs a signal "Low" (paper is absent), but the second detector 73 outputs a signal "High" (paper is present). Since one of the first and second detectors 72 and 73 of the photosensor 71, that is, the second detector 73, outputs a signal indicating that the paper is present, the controller 100 determines that the displacement of the edge 5*a* of the continuous paper 5 is smaller than or equal to the allowable displacement D and is in a normal state.

Figure 7A:
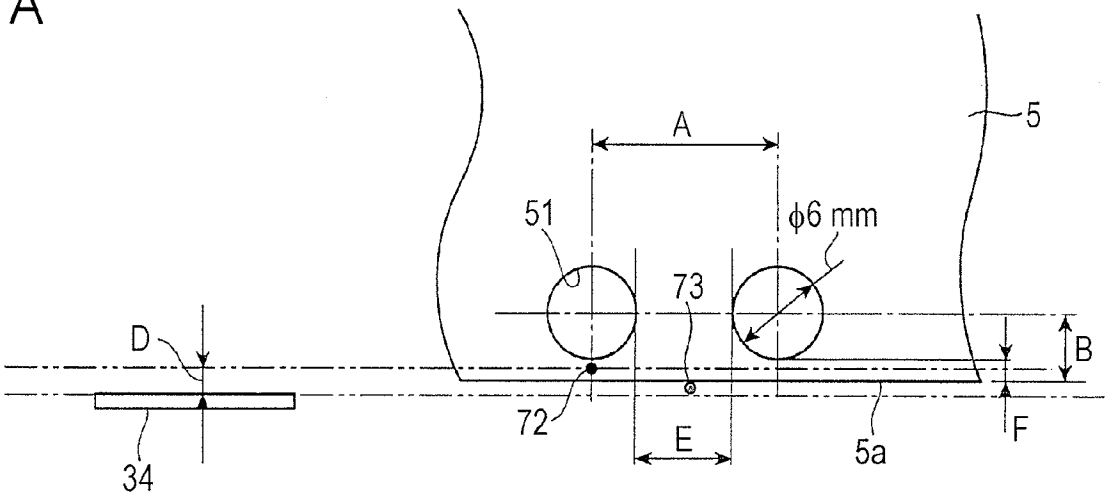
FIGS. 7A and 7B are schematic diagrams illustrating the manners in which an edge of the continuous paper is detected by the sheet-edge detecting device according to the first exemplary embodiment of the present invention.

When the edge 5*a* of the continuous paper 5 having the feed holes 51 with a diameter of 6 mm is displaced from the edge guide 34 but the displacement thereof is smaller than or equal to the allowable displacement D, as illustrated in FIG. 7A, the first detector 72 of the photosensor 71 outputs a signal "High" (paper is present). However, the second detector 73 outputs a signal "Low" (paper is absent) since the second detector 73 is outside the edge 5*a* of the continuous paper 5. Since one of the first and second detectors 72 and 73 of the photosensor 71, that is, the first detector 72, outputs a signal indicating that the paper is present, the controller 100 determines that the displacement of the edge 5*a* of the continuous paper 5 is smaller than or equal to the allowable displacement D and is in a normal state.

Figure 7B:
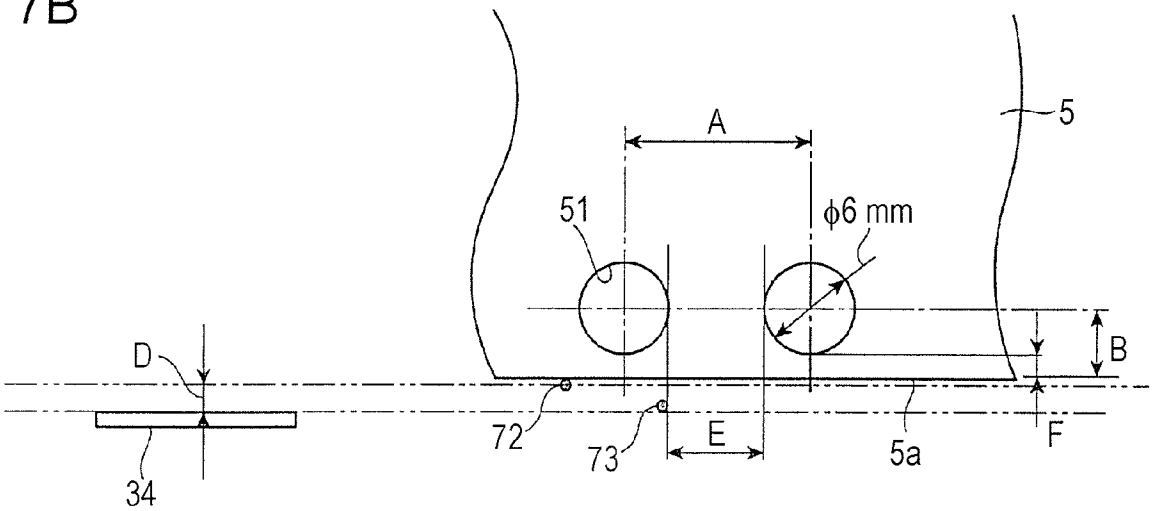

When the edge 5*a* of the continuous paper 5 having the feed holes 51 with a diameter of 6 mm is displaced from the edge guide 34 and the displacement thereof exceeds the allowable displacement D, as illustrated in FIG. 7B, the first and second detectors 72 and 73 of the photosensor 71 each output a signal "Low" (paper is absent). Since the first and second detectors 72 and 73 of the photosensor 71 each output a signal indicating that the paper is absent, the controller 100 determines that the displacement of the edge 5*a* of the continuous paper 5 is greater than the allowable displacement D and is in an abnormal state.

In this case, referring to FIG. 5, the controller 100 transmits a signal to the paper transport motor 102, which drives the transporting device 30, through the I/O interface 101 and stops the paper transport motor 102 so that the transporting device 30 stops transporting the continuous paper 5. In addition, the controller 100 also transmits a signal to the alarm display 103 so that a message "check paper transport position" or the like is displayed. Thus, the user is warned that the displacement of the edge 5*a* of the continuous paper 5 is greater than the allowable displacement D.

In the case where only one detecting unit is arranged at a position corresponding to the allowable displacement of the edge of the continuous paper 5 as in the structure of the related art, when one of the feed holes 51 in the continuous paper 5 is at the position of the detecting unit, there is a risk that the detecting unit will detect that the paper is absent even though the position of the continuous paper 5 is appropriate.

Thus, according to the above-described exemplary embodiment, the position of the edge 5*a* of the continuous paper 5 is determined on the basis of detection results obtained by the first and second detectors 72 and 73 of the photosensor 71, which are arranged in a predetermined positional relationship.

In the above-described exemplary embodiment, the first and second detectors 72 and 73 are arranged so as to be located between the adjacent feed holes 51 in the transporting direction of the continuous paper 5. However, the arrangement of the first and second detectors 72 and 73 is not limited to this as long as the first and second detectors 72 and 73 are prevented from being positioned in the same feed hole 51 or adjacent feed holes 51 at the same time.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet-edge detecting device comprising:

first and second detectors configured to be disposed at an edge of a transported sheet comprising feed holes arranged in a direction of the sheet, wherein the first and second detectors are configured to detect presence or absence of the sheet; and a controller configured to determine a position of the edge of the sheet using detection results obtained by the first and second detectors;

wherein the first and second detectors are configured to be separated from each other in the transporting direction of the sheet such that the first and second detectors cannot be simultaneously positioned in one or more of the feed holes, wherein the first and second detectors are configured to be separated from each other in a direction perpendicular to the transporting direction of the sheet such that the first and second detectors cannot be simultaneously positioned in one of the feed holes and outside the edge of the sheet, wherein one of the first and second detectors is configured to be located at a position corresponding to an allowable displacement of the edge of the sheet, and wherein the other one of the first and second detectors is configured to be located closer to the edge of the sheet than the one of the first and second detectors.

2. The sheet-edge detecting device according to claim 1, wherein the sheet-edge detecting device further comprises the sheet.

3. The sheet-edge detecting device according to claim 1, wherein the sheet-edge detecting device is configured such that, when a distance between centers of adjacent feed holes in the sheet is A, a distance from the edge of the sheet to centers of the feed holes is B, a diameter of the feed holes in the sheet is C, and the allowable displacement of the edge of the sheet is D, a distance ΔX between the first and second detectors in the transporting direction of the sheet and positions Y1 and Y2 of the one of the first and second detectors and the other one of the first and second detectors, respectively, in the direction perpendicular to the transporting direction of the sheet with reference to the edge of the sheet satisfy the following relationships:

when $C<\Delta X<A-C$ and $Y1<B-C/2$, $Y2\leq Y1$;

when $B-C/2\leq Y1\leq B+C/2$, $C<Y2\leq Y1$; and when $B+C/2<Y1$, $Y1-(B-C/2)<Y2\leq Y1$.

4. The sheet-edge detecting device according to claim 3, wherein the first and second detectors are configured to be arranged along a line that extends nonparallel to the transporting direction of the sheet.

5. The sheet-edge detecting device according to claim 1, wherein the first and second detectors are configured to be arranged along a line that extends nonparallel to the transporting direction of the sheet.

6. An image forming apparatus comprising:

an imaging forming configured to form an image on a continuous sheet;

a transporting unit configured to transport the sheet to the image forming unit;

a regulating unit configured to regulate an edge of the sheet, which is transported by the transporting unit, in a direction perpendicular to a transporting direction of the sheet; and an edge detector configured to detect the edge of the sheet regulated by the regulating unit, wherein the edge detector includes the sheet-edge detecting device according to claim 1.

7. An image forming apparatus comprising:

an imaging forming unit configured to form an image on a continuous sheet;

a transporting unit configured to transport the sheet to the image forming unit;

a regulating unit configured to regulate an edge of the sheet, which is transported by the transporting unit, in a direction perpendicular to a transporting direction of the sheet; and an edge detector configured to detect the edge of the sheet regulated by the regulating unit, wherein the edge detector includes the sheet-edge detecting device according to claim 3.

8. A method for detecting an edge of a sheet, the method comprising:

disposing first and second detectors at an edge of the sheet, wherein the sheet comprises feed holes arranged in a transporting direction of the sheet;

detecting, using the first and second detectors, presence or absence of the sheet; and determining, by a controller, a position of the edge of the sheet using results of the detecting;

wherein the first and second detectors are separated from each other in the transporting direction of the sheet such that the first and second detectors cannot be simultaneously positioned in one or more of the feed holes, wherein the first and second detectors are separated from each other in a direction perpendicular to the transporting direction of the sheet such that the first and second detectors cannot be simultaneously positioned in one of the feed holes and outside the edge of the sheet, wherein one of the first and second detectors is disposed at a position corresponding to an allowable displacement of the edge of the sheet, and wherein the other one of the first and second detectors is disposed closer to the edge of the sheet than the one of the first and second detectors.

* * * * *